US009046097B2

(12) United States Patent
Scotti Del Greco et al.

(10) Patent No.: US 9,046,097 B2
(45) Date of Patent: Jun. 2, 2015

(54) TEST ARRANGEMENT FOR A CENTRIFUGAL COMPRESSOR STAGE

(71) Applicant: Nuovo Pignone S.p.A, Florence (IT)

(72) Inventors: Alberto Scotti Del Greco, Figline Valdarno (IT); Libero Tapinassi, Rufina (IT); Stefano Vanghi, Florence (IT); Filippo Gerbi, Sesto Fiorentino (IT); Chiara Cinelli, Barberino di Mugello (IT)

(73) Assignee: Nuovo Pignone S.P.A, Florence (IT)

( * ) Notice: Subject to any disclaimer, the term of this patent is extended or adjusted under 35 U.S.C. 154(b) by 272 days.

(21) Appl. No.: 13/719,329

(22) Filed: Dec. 19, 2012

(65) Prior Publication Data

US 2013/0152357 A1 Jun. 20, 2013

(30) Foreign Application Priority Data

Dec. 20, 2011 (IT) ..... CO2011A0069

(51) Int. Cl.

| | |
|---|---|
| ***B23Q 17/00*** | (2006.01) |
| ***G01M 15/00*** | (2006.01) |
| ***F04B 51/00*** | (2006.01) |
| ***F04D 27/00*** | (2006.01) |

(52) U.S. Cl.

CPC ..... *F04B 51/00* (2013.01); *F04D 27/001* (2013.01); *Y10T 29/49764* (2015.01)

(58) Field of Classification Search

CPC . F04D 27/001; F04D 27/002; F04D 15/0088; F04B 51/00; G01F 1/80; G01M 15/14

USPC ..... 415/30, 17; 417/53; 73/861.353, 73/112.05, 168; 29/407.01, 407.05, 29/407.09, 888.02, 888.024

See application file for complete search history.

(56) References Cited

U.S. PATENT DOCUMENTS

| | | | | | |
|---|---|---|---|---|---|
| 3,876,326 | A | * | 4/1975 | Weitz | 415/17 |
| 4,156,578 | A | * | 5/1979 | Agar et al. | 415/1 |
| 4,177,649 | A | * | 12/1979 | Venema | 62/209 |
| 4,275,987 | A | * | 6/1981 | Kountz et al. | 415/17 |
| 4,464,720 | A | * | 8/1984 | Agarwal | 701/100 |
| 4,546,618 | A | * | 10/1985 | Kountz et al. | 62/201 |
| 4,581,900 | A | * | 4/1986 | Lowe et al. | 62/228.1 |
| 4,608,833 | A | * | 9/1986 | Kountz | 62/228.1 |

(Continued)

FOREIGN PATENT DOCUMENTS

| | | | | | |
|---|---|---|---|---|---|
| EP | 2607711 | A2 | * | 6/2013 | F04D 27/00 |
| JP | 2002364553 | A | * | 12/2002 | F04B 51/00 |
| WO | 2009133017 | A1 | | 11/2009 | |

OTHER PUBLICATIONS

Italian Search Report and Written Opinion dated Jul. 3, 2012 which was issued in connection with the Italian Patent Application No. CO2011A000069 which was filed on Dec. 20, 2011.

*Primary Examiner* — Essama Omgba

(74) *Attorney, Agent, or Firm* — GE Global Patent Operation

(57) ABSTRACT

A system for testing a compressor is provided. The system comprises one or more compressors connected together in series to a test compressor wherein an output of the test compressor is connected to an input of a first compressor in the series, forming an overall loop, one or more process fluid coolers in the overall loop, one or more orifices in the overall loop, a control valve in the overall loop, and a first plurality of sensors configured adjacent to a process fluid input of the test compressor and a second plurality of sensors configured adjacent to a process fluid output of the test compressor.

12 Claims, 6 Drawing Sheets

(56) References Cited

U.S. PATENT DOCUMENTS

| | | | | | |
|---|---|---|---|---|---|
| 4,627,788 | A * | 12/1986 | Keyes et al. | 415/11 |
| 4,640,665 | A * | 2/1987 | Staroselsky et al. | 415/1 |
| 4,781,525 | A * | 11/1988 | Hubbard et al. | 415/30 |
| 4,949,276 | A * | 8/1990 | Staroselsky et al. | 700/282 |
| 4,971,516 | A * | 11/1990 | Lawless et al. | 415/1 |
| 5,195,875 | A * | 3/1993 | Gaston | 417/282 |
| 5,355,691 | A * | 10/1994 | Sullivan et al. | 62/201 |
| 5,553,997 | A * | 9/1996 | Goshaw et al. | 415/17 |
| 5,599,161 | A * | 2/1997 | Batson | 415/17 |
| 5,649,449 | A * | 7/1997 | Algers | 73/168 |
| 5,746,062 | A * | 5/1998 | Beaverson et al. | 62/228.3 |
| 5,894,736 | A * | 4/1999 | Beaverson et al. | 62/230 |
| 6,354,806 | B1 | 3/2002 | Bingham | |
| 6,487,869 | B1 * | 12/2002 | Sulc et al. | 62/230 |
| 6,503,048 | B1 * | 1/2003 | Mirsky | 415/1 |
| 6,648,606 | B2 * | 11/2003 | Sabini et al. | 417/53 |
| 6,691,047 | B1 * | 2/2004 | Fredericks | 702/47 |
| 6,918,307 | B2 * | 7/2005 | Ohlsson et al. | 73/861.353 |
| 7,094,019 | B1 * | 8/2006 | Shapiro | 415/27 |
| 7,112,037 | B2 * | 9/2006 | Sabini et al. | 415/118 |
| 7,841,825 | B2 * | 11/2010 | Chen et al. | 415/1 |
| 7,856,834 | B2 * | 12/2010 | Haley | 62/115 |
| 8,037,713 | B2 * | 10/2011 | Haley et al. | 62/510 |
| 8,132,448 | B2 * | 3/2012 | Nakamura et al. | 73/112.02 |
| 8,177,520 | B2 * | 5/2012 | Mehlhorn et al. | 417/53 |
| 8,522,606 | B2 * | 9/2013 | Iannuzzi et al. | 73/112.05 |
| 8,627,680 | B2 * | 1/2014 | Haley et al. | 62/498 |
| 8,763,464 | B2 * | 7/2014 | Emde et al. | 73/659 |
| 2002/0170349 | A1 * | 11/2002 | Soneda et al. | 73/168 |
| 2003/0133808 | A1 * | 7/2003 | Sabini et al. | 417/53 |
| 2005/0031443 | A1 | 2/2005 | Ohlsson et al. | |
| 2008/0101914 | A1 * | 5/2008 | Chen et al. | 415/1 |
| 2010/0162802 | A1 * | 7/2010 | Nakamura et al. | 73/112.02 |
| 2012/0121376 | A1 * | 5/2012 | Huis In Het Veld | 415/1 |
| 2012/0160021 | A1 * | 6/2012 | Iannuzzi et al. | 73/112.05 |
| 2014/0007663 | A1 * | 1/2014 | Berger | 73/112.05 |

* cited by examiner

TEST ARRANGEMENT FOR A CENTRIFUGAL COMPRESSOR STAGE

BACKGROUND OF THE INVENTION

Embodiments of the subject matter disclosed herein generally relate to methods and devices and, more particularly, to mechanisms and techniques for testing a stage of a multiple stage centrifugal compressor, and specifically testing the portion of the performance curve associated with very low to zero resistance or even a negative suction head.

Centrifugal compressors are utilized extensively in many industries today across a wide variety of applications. An important requirement in the manufacture, sale and delivery of centrifugal compressors is providing a performance curve for the centrifugal compressor that is based on empirical data with as little extrapolation as possible of the performance curve. Using current methods and systems for generating a performance curve for a centrifugal compressor, a prior art test system 100 is configured as shown in prior art FIG. 1. A centrifugal compressor 102 is connected to a gear box 104 and an electric motor 106. The gear box 104 and electric motor 106 are sized based on the requirements of the centrifugal compressor 102. Continuing with the prior art test system 100 example, the outlet 108 of the centrifugal compressor is piped through a control valve 110 and then a process fluid cooler 112 before returning to the centrifugal compressor inlet 114. It should be noted in the prior art example that sensors for recording operating parameters such as, but not limited to process fluid temperature and pressure are placed proximate to the centrifugal compressor outlet 108 and inlet 114.

The centrifugal compressor 102 is then operated with the control valve 110 at different positions such as, but not limited to, ten percent to one hundred percent open in increments of ten percent while data is collected from the sensors associated with the prior art test system 100. The collected data is then used to generate a performance curve for the centrifugal compressor as illustrated in prior art FIG. 2. Prior art FIG. 2 depicts a graph of Head versus Flow and shows the performance curve 202 based on the data collected from the test procedure with the control valve 110 in different positions of almost closed 204, partially open 206 and fully open 208. It should be noted in the prior art test system 100 that the resistance experience by the compressor is at a maximum, based on this test, when the control vale 110 is in the almost closed 204 position and at the minimum obtainable by this prior art test system when the control valve 110 is in the fully open 208 position.

The unknown section 210 of the performance curve is only determinate based on extrapolation with the prior art test system 100 and does not have a unique method of extrapolation. It should be noted in the prior art system 100 that although the control valve is fully open 208, there are still losses associated with the design of the system based on the presence of the components, and their associated losses, of the prior art test system 100. The combination of uncertainty in the extrapolation methods and the errors associated with extrapolation at a boundary condition have led to market pressure to provide empirically produced specifications in the unknown section 210 of the performance and even beyond to a negative head location on the centrifugal compressor performance curve.

Accordingly, it would be desirable to provide designs and methods that avoid the afore-described problems and drawbacks.

BRIEF SUMMARY OF THE INVENTION

According to one exemplary embodiment, there is a system for testing a compressor comprising one or more compressors connected together in series to a test compressor. An exemplary embodiment continues with an output of the test compressor connected to an input of the first compressor in the series, forming an overall loop. The overall loop contains one or more process fluid coolers, one or more orifices and a control valve in the overall loop. The system further comprises a first plurality of sensors configured adjacent to the process fluid input of the test compressor and a second plurality of sensors are configured adjacent to the process fluid output of the test compressor.

According to another exemplary embodiment, there is a system for sizing an electric motor associated with a test compressor, for optimally meeting the test compressor startup requirements. The exemplary embodiment comprises an auxiliary compressor connected to the test compressor wherein the process fluid output of the auxiliary compressor is connected to the process fluid input of the test compressor and a process fluid output of the test compressor is connected to a process fluid input of the auxiliary compressor, forming a test loop. Next in the exemplary embodiment, one or more process fluid coolers and one or more orifices are configured in the test loop. Continuing with the exemplary embodiment, a control valve is configured in the test loop. Further in the exemplary embodiment, a first plurality of sensors is configured adjacent to the process fluid input of the test compressor and a second plurality of sensors is configured adjacent to the process fluid output of the test compressor.

According to another exemplary embodiment, there is a method for obtaining non-extrapolated empirical data associated with the performance characteristics of a compressor at head values lower than head value losses associated with a test loop connected to the compressor. The method comprises connecting an auxiliary compressor to a main compressor in a test loop such that a process fluid output from the auxiliary compressor is connected to a process fluid input of the main compressor and a process fluid output from the main compressor is connected to a process fluid input of the auxiliary compressor. The method further comprises installing a control valve in the test loop between the auxiliary compressor and the main compressor, installing one or more process fluid coolers and one or more orifices in the test loop between the auxiliary compressor and the main compressor, installing a first plurality of sensors in the test loop adjacent to the process fluid input of the main compressor, and installing a second plurality of sensors in the test loop adjacent to the process fluid output of the main compressor. Further in the exemplary embodiment, the method comprises collecting data from the first plurality of sensors and the second plurality of sensors while operating the test loop at conditions such that the main compressor head is lower than head value losses associated with the test loop.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF THE EXEMPLARY EMBODIMENTS OF THE INVENTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of turbo-machinery including but not limited to compressors and expanders.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
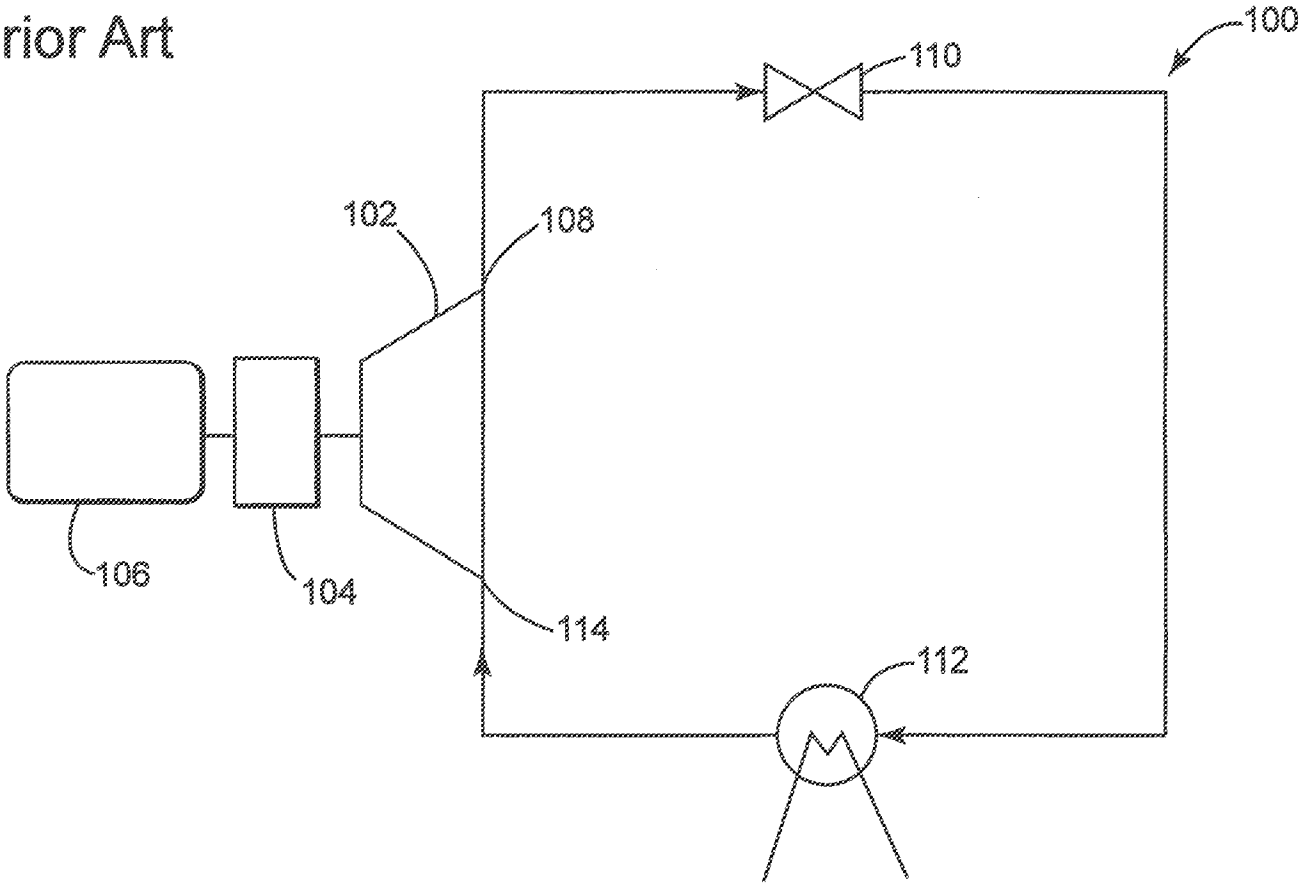
Figure 1 Prior Art
FIG. 1 is a prior art exemplary embodiment depicting a centrifugal compressor connected to a gear box and drive motor and configured with the outlet connected to the inlet through a control valve and a process fluid cooler.
Figure 2:
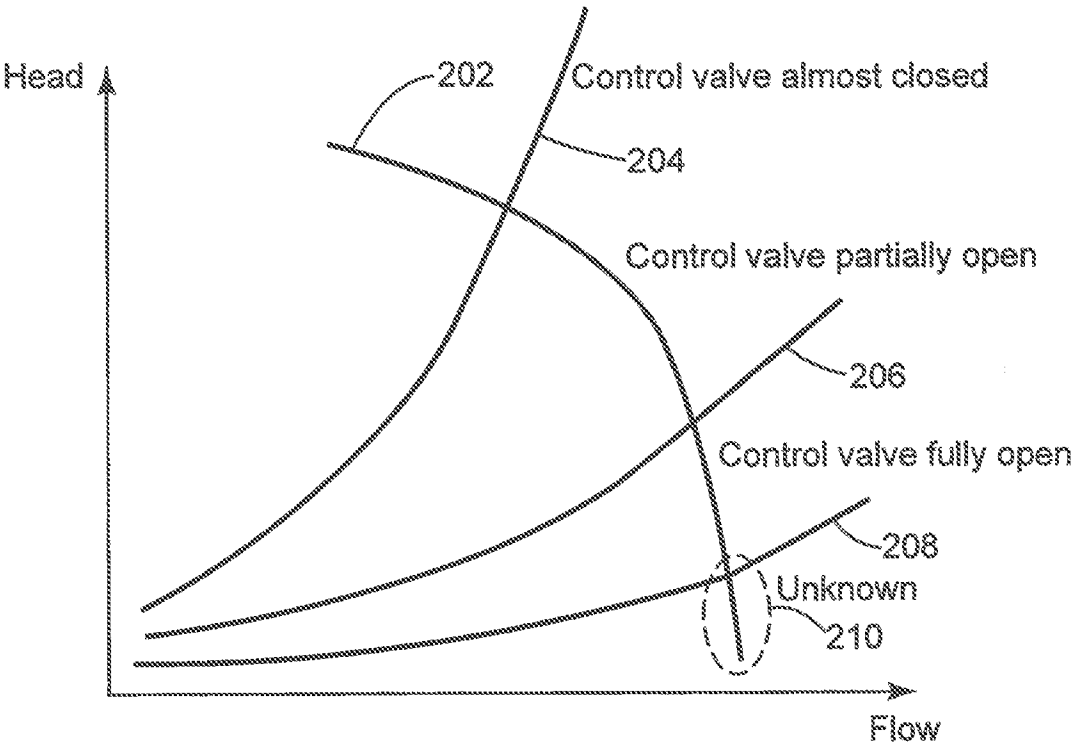
Figure 2 Prior Art
FIG. 2 is a prior art exemplary embodiment graph of a performance curve of a centrifugal compressor plotted on head versus flow axis through various resistance loads based on the position of the control valve.
Figure 3:
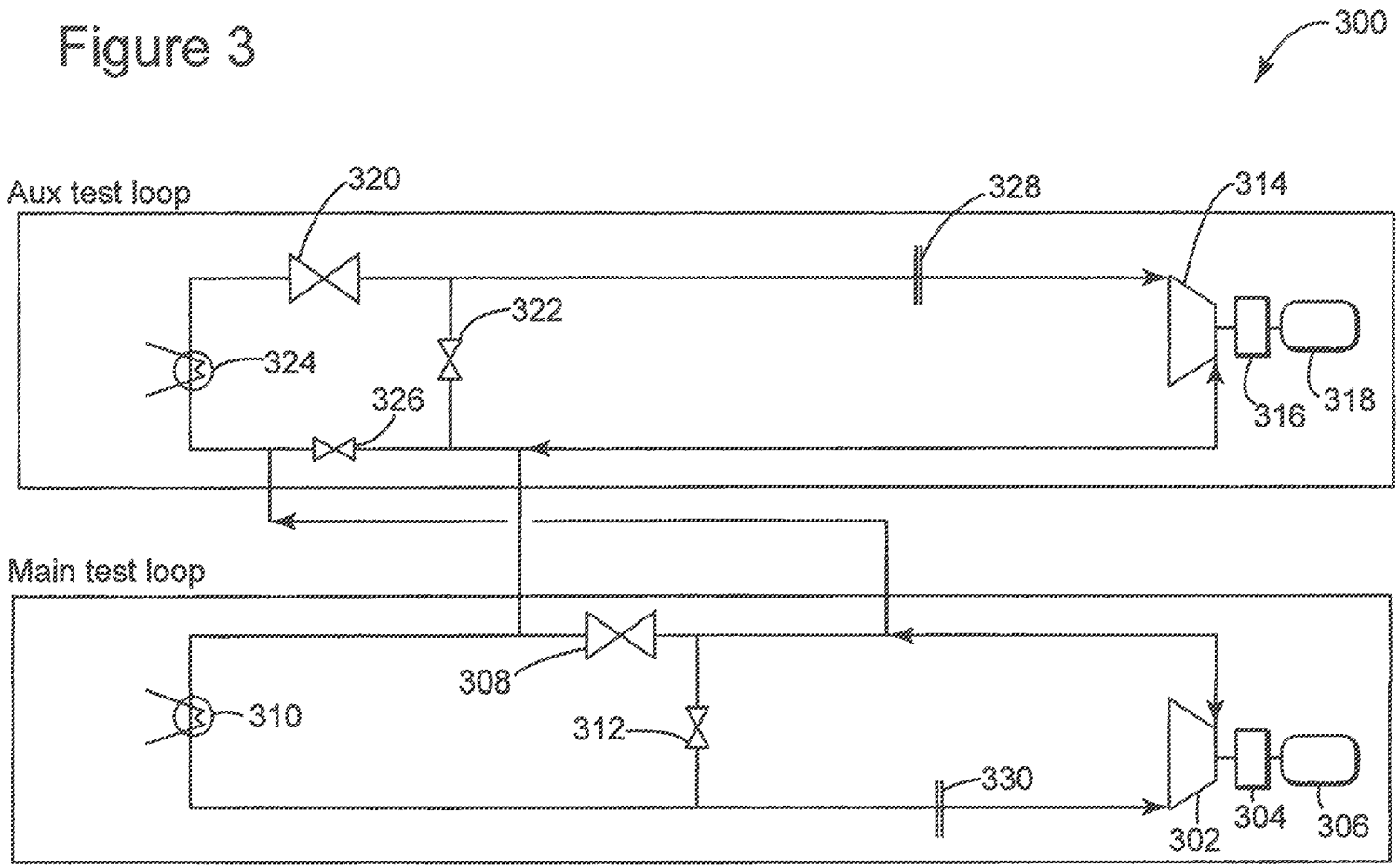
FIG. 3 is an exemplary embodiment depicting an auxiliary compressor loop and a test compressor loop connected in series and configured to allow performance testing of the test compressor to a zero head and further to a negative head condition.

FIG. 3 depicts an exemplary embodiment of a multi-centrifugal compressor test system 300 comprising three independent test loops based on a preconfigured multi-centrifugal compressor test system 300 configuration. The first test loop in the multi-centrifugal compressor test system is the main test loop and comprises main centrifugal compressor 302 connected to a gear box 304 and a motor 306. Continuing with the exemplary embodiment, the process fluid output from main centrifugal compressor 302 is connected to the process fluid input of main centrifugal compressor 302 first through a control valve 308, then through a process fluid cooler 310 and then through an orifice 330. It should be noted in the exemplary embodiment that a bypass valve 312 is required for directing process fluid flow based on whether the system is operating as a main test loop or an overall test loop.

Continuing with the exemplary embodiment, the second test loop in the multi-centrifugal compressor test system 300 is the auxiliary test loop and comprises auxiliary centrifugal compressor 314 connected to an auxiliary gear box 316 and an auxiliary motor 318. Next in the exemplary embodiment, the process fluid output from auxiliary compressor 314 is connected to the process fluid input of auxiliary centrifugal compressor 314 first through an auxiliary valve 326, then through an process fluid auxiliary cooler 324, then through an auxiliary control valve 320 and then through an auxiliary orifice 328. It should be noted in the exemplary embodiment that a bypass valve 322 is required for directing process fluid flow based on whether the system is operating as a main test loop or an overall test loop.

Next in the exemplary embodiment, the third test loop in the multi-centrifugal compressor system 300 is the overall test loop and comprises connecting the main centrifugal compressor 302 and the auxiliary centrifugal compressor 314 in series. It should be noted in the exemplary embodiment that the output of the auxiliary centrifugal compressor 314 feeds the input of the main centrifugal compressor 302 and the output of the main centrifugal compressor 302 feeds the input of the auxiliary centrifugal compressor 314. Continuing with the exemplary embodiment, a connection is made from a branching connection in the auxiliary test loop, between the auxiliary centrifugal compressor 314 and the auxiliary valve 326, to a branching connection in the main test loop, between the control valve 308 and the process fluid cooler 310. Next in the exemplary embodiment, a connection is made from a branching connection in the main test loop, between the main centrifugal compressor 302 and the main control valve 308, to a branching connection in the auxiliary test loop, between the auxiliary valve 326 and the auxiliary cooler 324. It should be noted in the exemplary embodiment that other piping arrangements are possible and that the branching locations can be placed in different positions with respect to other system components.

Continuing with the exemplary embodiment, it should be noted that the multi-centrifugal compressor test system 300 can be operated as a test system for the auxiliary centrifugal compressor 314, a test system for the main centrifugal compressor 302 and a test system for the main centrifugal compressor 302 wherein the auxiliary centrifugal compressor 314 and the main centrifugal compressor 302 are operated in series allowing testing of the main centrifugal compressor 302 with a zero or even a negative resistance. Next in the exemplary embodiment, the auxiliary centrifugal compressor 314 test loop can be operated by closing auxiliary bypass valve 322, closing main bypass valve 312 and opening auxiliary valve 326. In the exemplary embodiment, process fluid flow is controlled by auxiliary control valve 320 and cooled by auxiliary cooler 324. Further in the exemplary embodiment, the main centrifugal compressor test loop can be operated by closing auxiliary bypass valve 322 and closing main bypass valve 312. In the exemplary embodiment, process fluid flow is controlled by main control valve 308 and cooled by main cooler 310. Continuing with the exemplary embodiment, the overall test loop, i.e., operating the auxiliary centrifugal compressor and the main centrifugal compressor in series, can be operated by closing auxiliary valve 326 and main control valve 308 and opening auxiliary bypass valve 322 and main bypass valve 312. In the exemplary embodiment, the process fluid flow is controlled by auxiliary control valve 320 and cooled by auxiliary cooler 324. It should be noted in the exemplary embodiment that the auxiliary centrifugal compressor is a larger capacity compressor than the main centrifugal compressor. It should be noted in the exemplary embodiment that when operating in the overall test loop, the auxiliary centrifugal compressor 314 overcomes the losses of the overall test loop and allows the main centrifugal compressor 302 to operate at vanishing or even negative heads allowing the performance for the main centrifugal compressor to be measured directly at these operating conditions. It should further be noted in the exemplary embodiment that auxiliary orifice 328 and/or main orifice 330 are included in flow path of the overall test loop.

Figure 4:
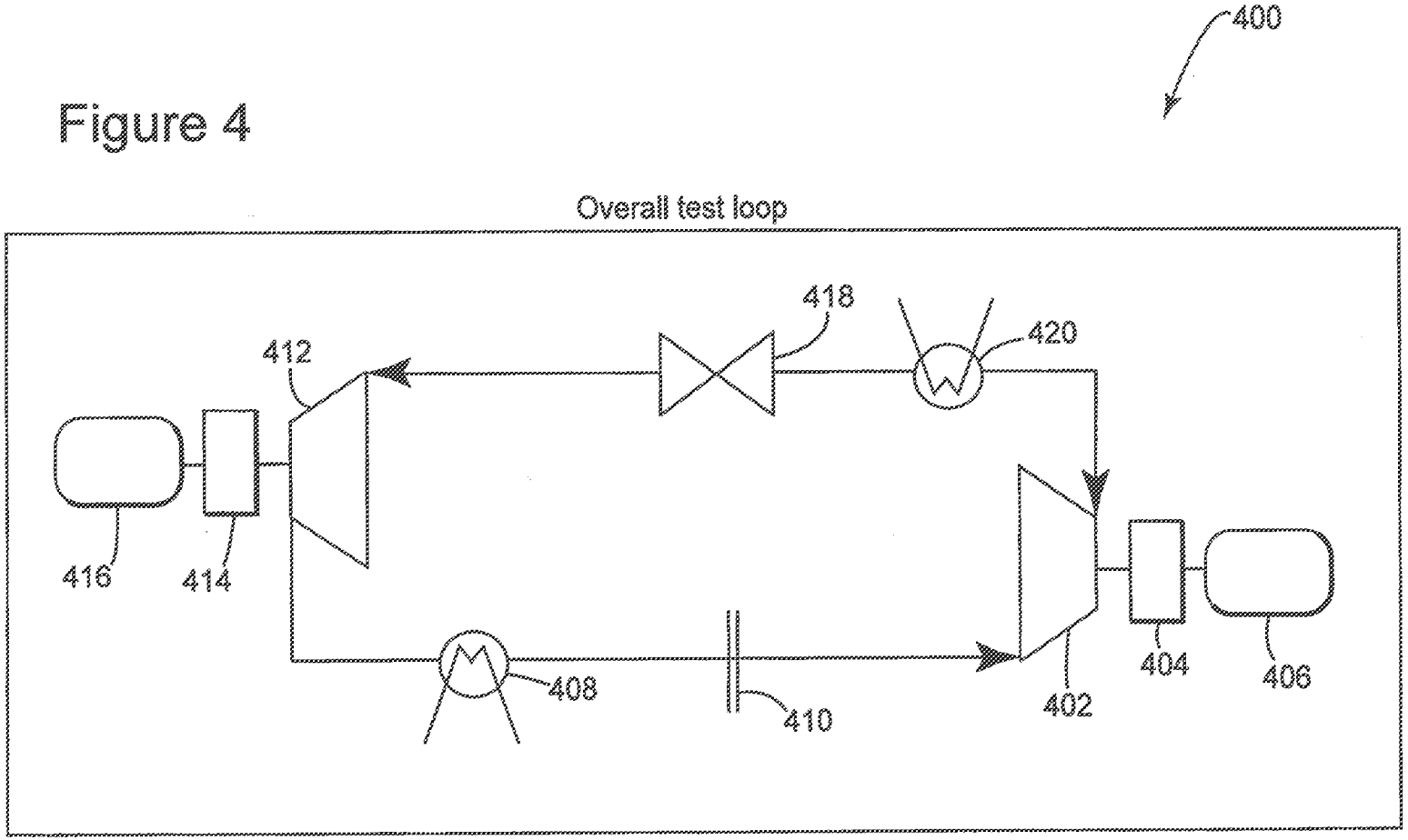
FIG. 4 is an exemplary embodiment depicting the flow path of the process fluid in an overall test loop of an auxiliary compressor and a test compressor connected in series and configured to allow performance testing of the test compressor to a zero head and further to a negative head condition.

FIG. 4 depicts an exemplary embodiment of a process fluid flow path for an overall test loop 400. Continuing with the exemplary embodiment, a test compressor 402 is connected in series to an auxiliary compressor 412. Next in the exemplary embodiment, the process fluid output from the main compressor flows through an auxiliary cooler 420 then through a control valve 418 before entering as input process fluid to auxiliary compressor 412. Continuing with the exemplary embodiment, the process fluid output from auxiliary compressor 412 flows through a process fluid cooler 408 and an orifice 410 before entering as input to test compressor 402. It should be noted in the exemplary embodiment that auxiliary compressor 412 is connected to an auxiliary gear box 414 and auxiliary motor 416 and test compressor 402 is connected to a gear box 404 and a motor 406. It should further be noted in the exemplary embodiment that auxiliary compressor 412 and test compressor 402 can be centrifugal compressors. It should also be noted that an additional orifice can be configured in the overall test loop between the auxiliary cooler 420 and the auxiliary compressor 412.

Figure 5:
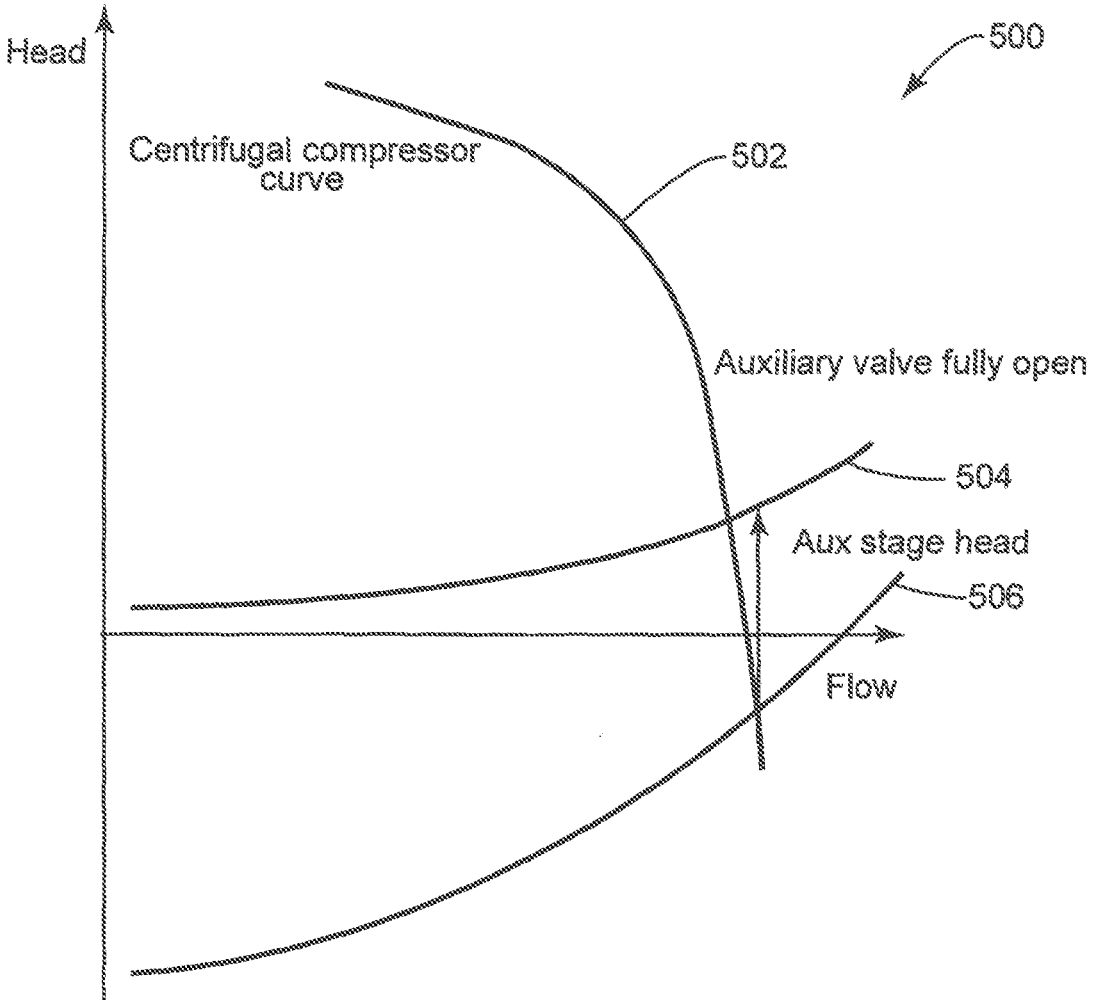
FIG. 5 is an exemplary embodiment graph of a performance curve of a centrifugal compressor plotted on head versus flow axis through various resistance loads based on the position of the control valve through a negative head resistance condition based on an auxiliary and test centrifugal compressors connected in series.

In FIG. 5, a graph 500 depicts Head versus Flow for a main centrifugal compressor and shows the performance curve 502 based on the data collected from an overall test loop procedure with the auxiliary control valve 418 in the fully open position 504 and the auxiliary centrifugal compressor 412 delivering compressed process fluid flow 506 to the main centrifugal compressor 402 inlet and reducing the resistance to the main centrifugal compressor 402 allowing the collection of empirical data related to the performance characteristics of the main centrifugal compressor 402 zero resistance or even negative head operating conditions. It should be noted in the exemplary embodiment that operation of the multi-centrifugal compressor test system 300, 400 and the data collected and graphed as represented by graph 500 can be used to size an electric motor for a centrifugal compressor such that it is the appropriate size based on centrifugal compressor startup requirements, i.e., a smaller motor can be specified based on non-extrapolated empirical data from a zero head, or even a negative head, condition.

Figure 6:
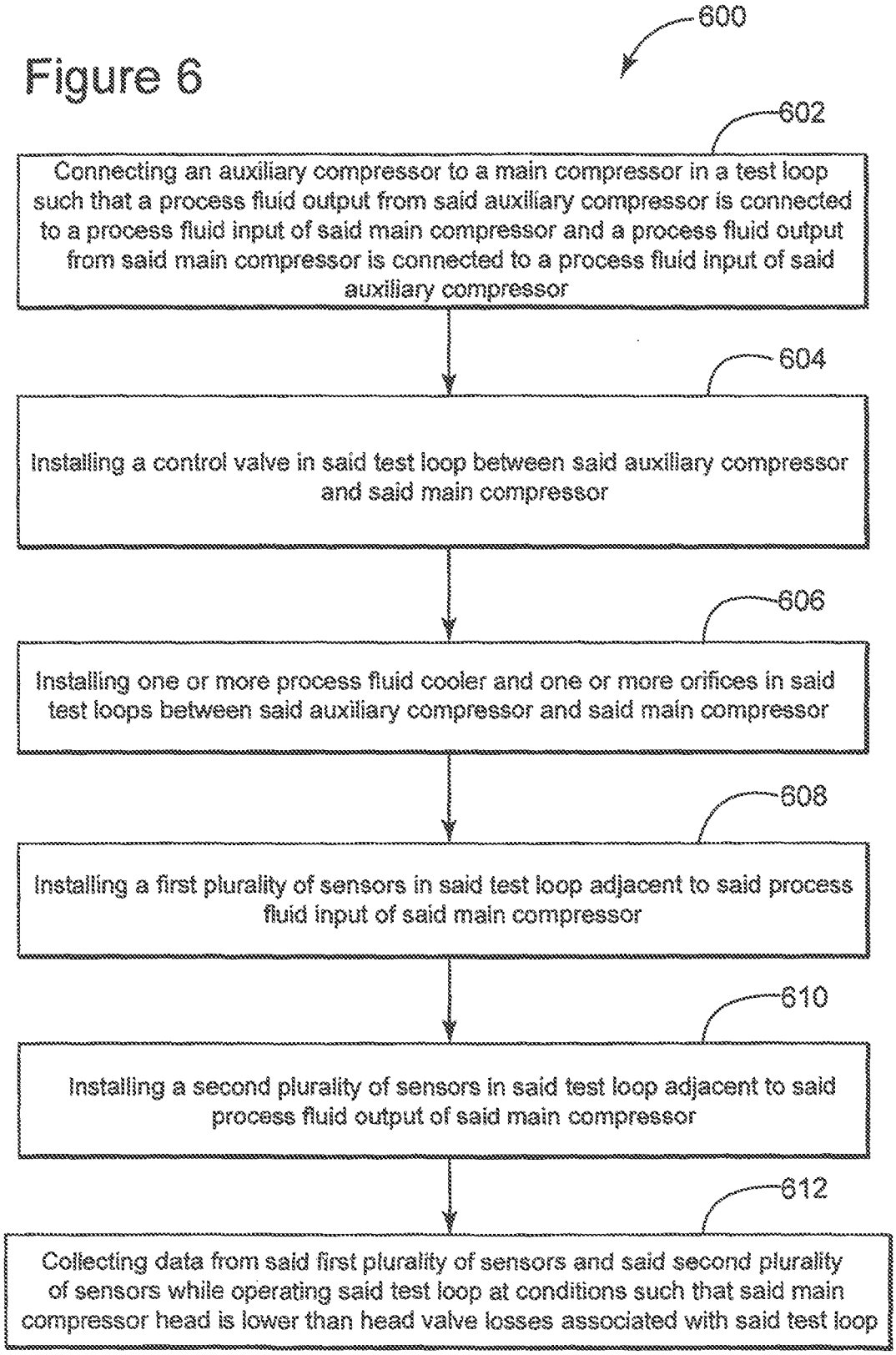
FIG. 6 is an exemplary method embodiment flowchart depicting a method for obtaining non-extrapolated empirical data associated with performance characteristics of a compressor at head values lower than the head value losses associated with a test loop connected to the compressor.

FIG. 6 depicts a flowchart 600 of an exemplary method embodiment for obtaining non-extrapolated empirical data associated with the performance characteristics of a compressor at head values lower than the head value losses associated with a test loop connected to the compressor. First at step 602 of the exemplary embodiment, an auxiliary compressor is connected to a main compressor, the test compressor, in a test loop. It should be noted in the exemplary method embodiment that the process fluid output of the auxiliary compressor is connected to the process fluid input of the main compressor and the process fluid output of the main compressor is connected to the process fluid input of the auxiliary compressor. It should also be noted in the exemplary method embodiment that the auxiliary compressor has a greater output capacity than the main compressor under test.

Next at step 604 of the exemplary method embodiment, a control valve is installed in the test loop between the auxiliary compressor and the main compressor. Continuing with the exemplary embodiment, the control valve allows the test loop resistance to be changed for different runs of the test loop providing the capability to collect data and develop a test compressor performance curve. It should be noted in the exemplary embodiment that when the control valve is fully open, the test compressor can be operated, allowing the collection of performance data, at test compressor heads approaching zero or even under a negative condition.

Next at step 606 of the exemplary method embodiment, a process fluid cooler is installed in the test loop between the auxiliary compressor and the main compressor. It should be noted in the exemplary embodiment that the location of the process fluid cooler can have an optimal installation location, such as in the test loop portion flowing from the main compressor to the auxiliary compressor, based on the configuration of the test being performed and the auxiliary compressor and main compressor installed in the test loop.

Continuing with step 608 of the exemplary method embodiment, sensors are installed in the control loop adjacent to the process fluid input connection on the main compressor. It should be noted in the exemplary method embodiment, that the sensors can, but are not limited to, measuring temperature, pressure, volumetric flow, mass flow, etc. It should further be noted in the exemplary method embodiment that the data collected from these sensors is included in generating a performance curve for the main compressor. Next, at step 610 of the exemplary method embodiment, sensors are installed in the control loop adjacent to the process fluid output connection on the main compressor. It should be noted in the exemplary method embodiment, that the sensors can, but are not limited to, measuring temperature, pressure, volumetric flow, mass flow, etc. It should further be noted in the exemplary method embodiment that the data collected from these sensors is included in generating a performance curve for the main compressor.

Continuing at step 612 of the exemplary embodiment, data is collected from the sensors installed in the control loop while the compressors are operating at various resistance conditions dictated by the position of the control valve. It should be noted in the exemplary embodiment that when the control valve is in the fully open position, the main compressor head at the process fluid input approaches zero and can even reach a negative head value. These circumstances of the exemplary method embodiment allow the collection of data for generating a main compressor performance curve without having to resort to extrapolation of data in this region important to startup procedures for a compressor.

The disclosed exemplary embodiments provide a system and a method for reducing the size of a centrifugal compressor while maintaining the performance characteristic of the larger centrifugal compressor. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements to those recited in the literal languages of the claims.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A system for testing a compressor, the system comprising:

one or more compressors connected together in series to a test compressor wherein an output of the test compressor is connected to an input of a first compressor in the series, forming an overall loop;

one or more process fluid coolers in the overall loop;

one or more orifices in the overall loop;

a control valve in the overall loop; and a first plurality of sensors configured adjacent to a process fluid input of the test compressor and a second plurality of sensors configured adjacent to a process fluid output of the test compressor.

2. The system of claim 1, wherein the test compressor is a centrifugal compressor.

3. The system of claim 2, wherein the one or more compressors are centrifugal compressors.

4. The system of claim 1, wherein the one or more compressors have a cumulative output capacity greater than the test compressor.

5. The system of claim 4, wherein the cumulative output capacity is sufficient to overcome head value losses associated with the overall loop.

6. The system of claim 5, wherein the testing is associated with generating a test compressor performance curve based on non-extrapolated empirical data for the test compressor at head values lower than the head value losses associated with operating conditions of the overall loop.

7. The system of claim 1, further comprising connecting a separate motor and gear box to each of the one or more compressors and to the test compressor.

8. The system of claim 1, further comprising a plurality of valves configured in the overall loop such that each of the compressors and the test compressor can be isolated and operated as an independent test loop.

9. A method for obtaining non-extrapolated empirical data associated with performance characteristics of a compressor at head values lower than head value losses associated with a test loop connected to the compressor, the method comprising:

connecting an auxiliary compressor to a main compressor in a test loop such that a process fluid output from the auxiliary compressor is connected to a process fluid input of the main compressor and a process fluid output from the main compressor is connected to a process fluid input of the auxiliary compressor;

installing a control valve in the test loop between the auxiliary compressor and the main compressor;

installing one or more process fluid coolers and one or more orifices in the test loop between the auxiliary compressor and the main compressor;

installing a first plurality of sensors in the test loop adjacent to the process fluid input of the main compressor;

installing a second plurality of sensors in the test loop adjacent to the process fluid output of the main compressor; and collecting data from the first plurality of sensors and the second plurality of sensors while operating the test loop at conditions such that the main compressor head is lower than head value losses associated with the test loop.

10. The method of claim 9, wherein the main compressor and the auxiliary compressor are centrifugal compressors.

11. The method of claim 9, wherein a cumulative output capacity is sufficient to overcome head value losses associated with the test loop.

12. A method for sizing an electric motor associated with a single or multistage compressor, for optimally meeting the compressor startup requirements, the method comprising:

obtaining, using the method of claim 9, non-extrapolated empirical data for each stage of the compressor;

calculating an overall performance map of the compressor using the non-extrapolated empirical data for each stage of the compressor; and calculating the absorbed power of the compressor at startup using the overall performance map of the compressor to size the electric motor.

* * * * *